United States Patent [19]

Gazapo et al.

[11] Patent Number: 4,756,772

[45] Date of Patent: Jul. 12, 1988

[54] METHOD OF COLORING A POROUS ANODIC OXIDE FILM ON THE SURFACE OF AN ALUMINUM ARTICLE

[75] Inventors: Jose L. Gazapo, Alicante, Spain; Dan Fern, Kingston, Canada

[73] Assignee: Alcan International Limited, Montreal, Canada

[21] Appl. No.: 664,237

[22] Filed: Oct. 24, 1984

[30] Foreign Application Priority Data

Oct. 31, 1983 [GB] United Kingdom ..... 8329029

[51] Int. Cl.[4] ..... C23C 22/56; C23C 22/66

[52] U.S. Cl. ..... 148/6.27; 427/343; 427/419.2

[58] Field of Search ..... 148/6.27, 6.1; 427/327, 427/343, 331, 419.2, 434.2, 434.6, 435, 419.8; 204/35.1, 38.3

[56] References Cited

U.S. PATENT DOCUMENTS

| | | | |
|---|---|---|---|
| 2,927,872 | 3/1960 | Cohn | 148/6.27 |
| 3,247,791 | 4/1966 | Leonard | 148/6.27 |
| 3,749,596 | 7/1973 | Yoshimura | 148/6.27 |
| 4,018,628 | 4/1977 | Paulet | 148/6.27 |
| 4,105,511 | 8/1978 | Nikaido et al. | 204/38.3 |

FOREIGN PATENT DOCUMENTS

| | | | |
|---|---|---|---|
| 1049949 | 3/1979 | Canada | 204/22 |
| 44-23204 | 10/1969 | Japan | 148/6.27 |
| 55-6448 | 1/1980 | Japan | 148/6.27 |
| 489574 | 7/1938 | United Kingdom | 148/6.1 |
| 502360 | 3/1939 | United Kingdom | 204/38.3 |
| 1383241 | 2/1975 | United Kingdom | 204/35.1 |

*Primary Examiner*—Sadie L. Childs

*Attorney, Agent, or Firm*—Cooper & Dunham

[57] ABSTRACT

Aluminum articles having porous anodic oxide films are given an exposure-resistant blue coloration by dipping them first in an aqueous solution of a phosphomolybdic acid or a silicomolybdic acid, and then in a solution of a strong reducing agent such as a stannous salt, and finally sealing the porous oxide film. The method is suitable for batch or continuous operation and useful to color bumpers for passenger cars.

10 Claims, No Drawings

METHOD OF COLORING A POROUS ANODIC OXIDE FILM ON THE SURFACE OF AN ALUMINUM ARTICLE

The present invention relates to colouring anodised aluminium and in particular it relates to a non-electrolytic method for producing a blue colouration which exhibits resistance to weather and to ultra-violet radiation.

It is well known to colour anodised aluminium by means of organic dyestuffs, but such colouration has little resistance to outdoor conditions and fades relatively rapidly on exposure.

For anodised aluminium components, such as window frames, which are subject to continuous exposure to atmosphere, it has become common practice to employ an electrolytic colouring process. Such processes result in very stable colouration, usually in a rather dark colour. Electrolytic colouring processes are, however, expensive in terms of electric power, labour and the cost of the capital equipment employed.

There is a demand for a process for colouring anodised aluminium more economically than can be achieved electrolytically, even if some loss of stability ensues.

The process of the present invention has been developed with the object of solving a particular requirement for a very pale blue colouration of anodised aluminium, but the process to be described below may be employed to produce blue colour in a quite wide range of shades (strength of colour) and tints.

The problem, to which the process of the present invention in one form is a response, is the colouration of bumpers for passenger cars. At the present time conventional chromium-plated steel bumpers are being replaced by anodised aluminium alloy bumpers. Such bumpers are commonly fabricated in Cu-containing alloys of the 7000 series to provide greater resistance to impact. However, when such alloys are anodised, the anodic oxide film tends to exhibit a somewhat yellowish tone, which can lead to customer-resistance. In order to avoid this possible objection to aluminium alloy bumpers, car manufacturers seek a very pale blue colouration in the anodic oxide film to simulate the appearance of conventional chromium plating and to mask the undesired yellowish tone, which results when Cu-containing aluminium alloys are anodised.

To be satisfactory for the intended purpose the blue colour must exhibit reasonable light fastness on exposure to outdoor conditions.

Since the production of car bumpers is a high volume operation, a process for colouration of an anodic coating of such items preferably does not require very critical control of the operating conditions and, amongst other objects of the invention, it is desired to provide a process which, in at least one of its forms, can be operated without especially critical control of its operating parameters.

It has long been known that anodic oxide films can be coloured by inorganic pigmentary materials, using a purely chemical double-dip technique: that is to say, the pigment is deposited on or in the anodic oxide film by dipping anodised aluminium into two successive baths, from which soluble chemical components are taken up and react to deposit an insoluble pigment.

Very many different procedures for colouring anodised aluminium in this way have been proposed during the last fifty years, but in very few instances has the resulting colour been stable to weather and ultra-violet radiation and it has not previously been found possible to produce a blue colour, which is relatively stable when the coloured anodised aluminium is exposed to outdoor conditions, and which can be employed to stimulate the appearance of chromium plate, by means of a non-electrolytic process.

It is well known that blue colours can be obtained by the reduction of hexavalent molybdenum compounds in acid solution.

It has already been proposed in British Pat. No. 1,383,241 to colour anodised aluminium by an electrolytic treatment in which alternating current is passed between an anodised aluminium article and a counter-electrode while immersed in an electrolyte containing an ionizable compound of molybdenum or tungsten. The compounds specifically employed in the electrolyte were acidified ammonium heptamolybdate, silicomolybdic acid ($H_8Si(Mo_2O7)_6$) or silicotungstic acid ($H_8Si(W_2O_7)6$). A stable blue colour was said to have been obtained. The colouring process could also be employed to colour an anodic oxide film which had already been electrolytically coloured in a different electrolyte.

A stable blue colour is said to have been produced in a process described in Japanese Patent Publication No. 55.006448 in which an anodised aluminium article was employed as cathode in a D.C. electrolytic colouring process, performed in an acid solution of a molybdate.

It is explained in German Patent Specification No. 2,364,405 that electrolytic colouration of already electrolytically coloured anodised aluminium in an electrolyte containing a polysilico- or a polyphosphoacid of molybdenum or tungsten may result in defects, such as lack of colour uniformity. It is however stated that a stable and uniform colour is produced when anodised aluminium, electrolytically coloured in a solution of a salt of a restricted range of elements more electronegative than copper, is subsequently dipped in a solution of a polysilico- or polyphosphoacid of molybdenum or tungsten.

The basic colouration due to the polyheteromolybdic or- tungstic acid appears to be the result of reaction between the polyhetero acid and the metal particles deposited in the pores of the anodic oxide film in the preceding electrolytic colouring stage.

This two-stage treatment produced a grey colouration. It was said that the colour could be intensified by employing a third process stage in which the anodised aluminium article was dipped in a solution of a reducing agent, such as stannous chloride. However, it was well recognized in this German Patent Specification that it was difficult to obtain colour uniformity and reproducibility in any process relying on a two-stage chemical dipping process.

There is no suggestion in German Patent Specification No. 2,364,405 that a stable light-fast colour can be produced on anodised aluminium by dipping an anodised aluminium article, which has not been subjected to an electrolytic colouring treatment, in a solution of a polyhetero acid of phosphorus or silicon with molybdenum or tungsten.

We have however now discovered that very useful exposure-resistant blue colours can be formed by dipping the anodised aluminium article in a solution of a phospho- or a silico molybdic acid (but not in a solution of the corresponding polyhetero tungstic acid) followed by immersion in a solution of a strong reducing agent and finally sealing the anodic oxide film. Particularly advantageous results are obtained where the reducing agent is a stannous salt.

Although a much wider range of blue colours can be obtained when phosphomolybdic acid is employed, valuable pale blue shades (such as can be employed to simulate chromium plate) may be obtained with silicomolybdic acid.

In carrying the invention into effect it has been found that the best results are obtained with a phosphomolybdic or silicomolybdic acid solution containing from 0.1 to 15 g/L. With solutions containing 1 to 15 g/L, more preferably 2 to 10 g/L phosphomolybdic acid, the article is preferably rinsed before immersion in the reducing agent to avoid excessive carry-over from one bath to the next.

The pH of the phosphomolybdic acid solution is preferably about that of the natural acid. If the pH is too high the desired blue colour is not generated, so the pH should preferably be not more than about 1 pH unit above the natural value for the acid. At the lower end of the range, the pH is generally at least 1 and preferably at least 1.3.

Phosphomolybdic acid and silicomolybdic acid are commercially available polyhetero acids. The temperature of the acid bath is preferably held at a selected temperature in the range of 15°–40° C., ambient temperature being particularly preferred, but higher or lower temperatures may be employed. Provided that the bath is held at a reasonably constant temperature, satisfactorily uniform results may be obtained. However, the temperature does have a substantial effect on the absorption of phosphomolybdic acid into the anodic oxide coating.

Provided that the anodised aluminium is maintained in the bath for a sufficient time to effect full absorption of the phosphomolybdic acid (or silicomolybdic acid), which usually requires about 3–4 minutes, the immersion time of the anodised aluminium in the first bath is in no way critical and the eventual colour is virtually independent of the immersion time.

When solutions containing more than about 1 g/L of polyhetero acid are used, it is preferred to remove excess solution from the surface of the dipped anodised aluminium to avoid contamination of the second stage reducing bath. This is preferably achieved by rinsing in deionized water. Phosphomolybdic acid is adsorbed into the pores of the anodic oxide film during dipping and therefore thorough rinsing for removal of excess phosphomolybdic acid from the surface of the film has only a minor adverse effect on the development of the desired colour. Inadequate rinsing can result in some loss of colour uniformity.

Nevertheless, excessive rinsing should be avoided if deep shades are desired. Rinsing should preferably be continued for less than 1 minute. Indeed, when polyhetero acid concentrations at and below about 1 g/L are employed, it is preferred not to rinse at all, and it is found that at these low concentrations no loss of colour uniformity arises.

In the second stage the anodised aluminium is preferably dipped for a period sufficient to achieve full development of the colour due to the polyhetero acid taken up in the first stage. Here again the dip time is not critical, provided that a minimum dip time, usually about 1 minute, is exceeded.

In contrast to an electrolytic colouring process, there is no criticality as to the immersion time of the anodised aluminium in either of the chemical dip stages provided that minimum immersion times are exceeded.

With a batch chemical dip colouring process it is advantageous and indeed virtually essential for satisfactory commercial operation that the process be essentially independent of dip time, since the lower end of the work is almost inevitably immersed for a longer time than the upper end and there would be loss of colour uniformity.

Where a stannous salt is employed as the reducing agent, a stabiliser should be included to hold down the rate of oxidation of the stannous salt. Sulphophthalic acid and sulphosalicylic acid are well known as stabilisers for this purpose and it is preferred to incorporate one of these substances in appropriate quantity (2 to 10 g/L) in a stannous sulphate bath of, for example, 5 to 10 g/L. The stabiliser employed does have some effect on the colour and light-fastness. On the other hand the temperature of the stannous sulphate solution has little or no effect on the strength or shade of the colour and the second stage bath is conveniently maintained at a temperature of 15°–25° C.

Other known anti-oxidation stabilisers may be employed in place of the above-mentioned organic acids, provided that they do not adversely affect to any substantial extent the quality of the subsequent sealing of the anodic oxide film. For example phenolsulphonic acid may be used: also such proprietary anti-oxidation stabilisers are available.

The stannous sulphate reducing bath may be replaced by other reducing agents of similar reducing potential, provided that such alternative reducing agents in aqueous solution may be adequately stabilised against oxidation. However, because of toxicity problems and stabilisation problems, stannous sulphate is greatly preferred to possible alternatives. Milder reducing agents, such as ferrous sulphate and sodium sulphite, tend to provide blue shades which are too pale for the foreseen end use of simulating chromium plate, but which may find utility in colouring anodic oxide films on Cu- free Al alloys.

The method of this invention, and particularly the steps of dipping the article in phospho- or silicomolybdic acid and then in a reducing agent, can also be carried out on a continuous basis. This applies particularly when the article is a continuous sheet of metal. In such cases, rinsing between dips may conveniently be effected by means of a spray rinse.

In order to achieve acceptable sealing of the coloured anodic oxide film it is important to carry out the sealing under essentially phosphate-free conditions or to employ well-known proprietary sealing agents which counteract the effect of phosphate. Because of the almost unavoidable drag over of phosphate into the sealing bath where phosphomolybdic acid is employed in the first stage, considerable care must be taken where conventional hot water sealing is employed. Phosphate contamination can be avoided by rinsing with water or by steam sealing or by the use of nickel-based sealing additives at or near boiling point or nickel fluoride/butyl alcohol at relatively low temperatures e.g. 30° C. Similarly, silicate contamination, resulting from the use of silicomolybdic acid, is preferably avoided and rinsing with water is suitable for this purpose.

As already stated the process of the present invention may be employed to produce a wide range of colour shades which depend upon the temperature and concentration of the phosphomolybdic bath. It is however found that the darker shades have less light stability than the lighter shades, which fulfil the stated purpose of simulating chromium plate. The most stable colours are found with phosphomolybdic acid baths having a temperature below about 40° C.

The development of colour on anodised aluminium is illustrated by the following examples.

EXAMPLE 1

(1) A 2 $dm^2$ sample of 7029 alloy is anodised in a sulpohuric acid bath (with a concentration of 180 g/L) until a film thickness of 7.5 microns is produced. At this stage the sample presents a light yellow colour.

This coupon is rinsed thoroughly with deionised water and dipped in a solution containing 2 g/L of phosphomolybdic acid at a pH of 1.9. The bath is maintained at room temperature and the time of immersion is 3 minutes.

After that the sample is rinsed with deionised water and immersed in a second bath held at room temperature and containing Stannous sulphate—5 g/L
Tartaric Acid—5 g/L during two minutes. A blue colour is developed on the surface of the sample that masks the yellow colour produced during the anodising.

After this treatment the sample is sealed in boiling water with a nickel salt additive.

EXAMPLE 2

A coupon with the same anodising treatment as in Example 1 is immersed in a phosphomolybdic acid solution containing 2 g/L at a temperature of 50° C. and, after rinsing, is dipped in the stannous sulphate/tartaric acid solution described in Example 1.

A medium to dark blue colour is developed on the surface. This colour is darker than the colour developed in the procedure of Example 1.

EXAMPLE 3

A sample, subjected to the same anodising treatment as Example 1, is dipped in a solution of 5 g/L of phosphomolybdic acid at room temperature for 5 minutes and, after rinsing, dipped in a reducing bath, held at room temperature and containing Stannous sulphate—10 g/L
Sulphosalicylic Acid—5 g/L during 2 minutes.

During the second dipping a blue-green colour is developed on the surface.

EXAMPLE 4

A sample of 5657 alloy is anodised in sulphuric acid until a film thickness of 10 microns is produced. The sample is rinsed and dipped in a solution of 3 g/L silicomolybdic acid during 5 minutes at room temperature and at pH 1.7–2.1.

The sample is rinsed in deionised water and immersed in a second bath held at room temperature and containing Stannous sulphate—5 g/L
Sulphosalicylic Acid—5 g/L During the second dipping treatment a light blue colour is developed on the surface and is retained after sealing.

EXAMPLE 5

STUDY OF THE EFFECT OF pH

One of the main factors affecting the development of the colour is the pH of the solution. Different solutions with pH between 3 and 0.7 in a solution containing 10 g/L of phosphomolybdic acid were prepared. The original pH of this solution was 1.47 and the pH was changed by means of additions of sulphuric acid and ammonium hydroxide.

The conclusions of this study were:

(a) The best pH to get blue colours with a phosphomolybdic acid solution of this strength is the original 1.47 pH of phosphomolybdic acid.

(b) Below pH:1 and above pH:2.4 it was not possible to produce any effective blue colour in the anodic coating.

The natural pH of aqueous solutions containing 0.1, 1.0 and 10 g/L of phosphomolybdic acid are 3.24, 2.6 and 1.47 respectively. Use of the acid at a pH higher than its natural one (for the concentration in question) may reduce the ability of the acid to produce an effective colour.

EXAMPLE 6

INFLUENCE OF THE TYPE OF SEALING

In order to study the influence of sealing on this type of finish four different methods of sealing were employed to seal samples produced by the procedure of Example 1.

1. Boiling water
2. Steam under pressure (110° C.)
3. Low temperature sealing (30° C.)(1)
4. Sealing with additives(2)

(1)The solution used for low temperature sealing has been: Isobutylic alcohol: 40 ml/L; Nickel acetate: 4.5 g/L; Ammonium fluoride: 2.85 g/L.

(2)Proprietary nickel-based sealing additive in boiling water.

The next Table gives the results of weight loss after testing in phosphoric/chromic acid (38° C., 15 minutes).

| | Sample | | | |
|---|---|---|---|---|
| | 1 | 2 | 3 | 4 |
| Weight Loss $Mg/dm^2$ | 87 | 23.2 | 25.4 | 3.2 |

Good sealing is important for pigment stability. With high weight loss in the above sealing test, accelerated leaching of the pigment is to be expected. In the above described phosphoric/chromic acid test a weight loss below 30 $mg/dm^2$ is satisfactory. The high weight loss experienced in boiling water shows that special care is required to achieve satisfactory results in boiling water without additives.

EXAMPLE 7

In order to determine sealing quality obtainable with different conditions samples at different temperatures and at different concentrations in the phosphomolybdic bath were prepared.

In the following Table are summarized the weight loss data for two different types of sealing.

| Weight Loss (mg/dm²) - Low Temperature Sealing (1) | | | |
|---|---|---|---|
| Conc. Phospho- | Temp °C. | | |
| molybdic acid g/L | 20 | 30 | 40 |
| 2 | 25.1 | 42.9 | 36.9 |
| 10 | 35.4 | 27.0 | 14.0 |

| Weight Loss (mg/dm²) - Proprietary sealing additive in boiling water | | | |
|---|---|---|---|
| Conc. Phospho- | Temp °C. | | |
| molybdic acid g/L | 20 | 30 | 40 |
| 2 | 3 | 2.7 | 2.9 |
| 10 | 1.6 | 2.6 | 3.07 |

The second set of tabulated results were obtained with one nickel-based proprietary sealing additive. However, any other comercially available sealing additive may be employed which results in a weight loss below 30 mg/cm² in the phosphoric/chromic acid test.

EXAMPLE 8

INFLUENCE OF SEALING ON LIGHT-FASTNESS

The same samples tested in Example 7 for sealing quality have been exposed for 110 hours in an ultraviolet cabinet in order to test light-fastness.

The results are summarized below:

| Degree of Fading(3) - Low Temperature Sealing | | | |
|---|---|---|---|
| Conc. Phosphomolybdic | Temp °C. | | |
| Acid g/L | 20 | 30 | 40 |
| 2 | 4–5 | 4–5 | 4–5 |
| 10 | 4–5 | 3 | 4–5 |

| Degree of Fading(3) Proprietary Sealing Additive (5 g/L) | | | |
|---|---|---|---|
| Conc. | Temp °C. | | |
| Phosphomolydic g/L | 20 | 30 | 40 |
| 2 | 4–5 | 5 | 4–5 |
| 10 | 5 | 4–5 | 4–5 |

(3) Grey Scale
5 No change
4 Slight change of colour
3 Moderate change of colour
2 Severe change of colour
1 Very severe change of colour
0 Total loss of colour

EXAMPLE 9

INFLUENCE OF SEALING TEMPERATURE AND PHOSPHOMOLYBDIC ACID CONCENTRATION ON LIGHT-FASTNESS

The next table shows the relationship between the temperature and concentration of the phosphomolybdic acid bath, and the light-fastness of the samples. All the samples were sealed in boiling water for 20 minutes.

| Conc. | Temp °C. | | | | | | |
|---|---|---|---|---|---|---|---|
| Phosphomolybdic g/L | 20 | 30 | 40 | 50 | 60 | 70 | 80 |
| 2 | 4–5 | 4 | 4–3 | 4 | — | — | — |
| 5 | 4–5 | 4 | 3 | 3 | 3 | 2–3 | 1 |

-continued

| Conc. | Temp °C. | | | | | | |
|---|---|---|---|---|---|---|---|
| Phosphomolybdic g/L | 20 | 30 | 40 | 50 | 60 | 70 | 80 |
| 10 | 4–5 | 4 | 4 | 2 | 1 | 2 | 2 |
| 15 | 5 | 4 | 4 | 3 | 3 | 1 | 1 |

Comparison with the preceding Table suggests that some improvement in colour stability can be achieved by the incorporation of a nickel-based sealing additive in the sealing bath.

The general conclusions of this test are. The darker colours have a greater tendency to fade. There is very little influence of the concentration of phosphomolybdic acid on the ultra-violet light-fastness test.

EXAMPLE 10

U.V. Test

Samples have been exposed for 100 hours under a mercury vapour U.V. bulb with a power of 1,200 watts, examining the samples every 24 hours.

The main parameters studied in this test have been the influence of the additives in the stannous sulphate solution and the intensity of the colour.

In order to study the influence of the additives in the stannous sulphate solution the samples were prepared as follows.

Anodising:
- Temperature 25° C.
- Current density 1.0 A/dm²
- Film thickness 7.5 micrometers.

First Dip:
- 2 g/L Phosphomolybdic Acid (pH=2.2)
- t=4 minutes.

Second Dip:
- 5 g/L stannous sulphate
- 5 g/L or 5 ml/L of stabilizers
- t=1 minute.

Sealing:
- 5 g/L of Sandoz sealing additive AS
- Temperature 100° C.

As stabilizers were used:
- (a) P-3 Almecolour stabilizers
- (b) KBL-II
- (c) KBL-III
- (d) Sulphophthalic Acid
- (e) Sulphosalicylic Acid The following Table gives a summary of the results of degradation of colour under U.V. light.

| U.V. COLOUR DEGRADATION OF STABILIZERS | | | | |
|---|---|---|---|---|
| | Time h | | | |
| Stabilizer | 25 | 50 | 75 | 100 |
| P-3 Almecolour | 5 | 4 | 4 | 4 |
| KBEL-II | 5–4 | 4 | 4 | 3 |
| KBEL-III | 5 | 4 | 4 | 4 |
| Sulphophthalic Acid | 5 | 5 | 5 | 4 |
| Sulphosalicylic Acid | 5 | 5 | 4 | 4 |

Degradation Scale
5 no change
4 slight change of colour
3 moderate change of colour
2 severe change of colour
1 very severe change of colour
0 total loss of colour Darker colours show better light fastness than lighter ones.

EXAMPLE 11

NO INTER-DIP RINSE WITH LOW-STRENGTH PHOSPHOMOLYBDIC SOLUTION

A coupon with the same anodizing treatment as in Example 1 is immersed in a phosphomolybdic acid solution containing 0.25 g/L at 25° C. with its natural pH at 3.1, for 4 minutes. The coupon is then, without any rinsing, dipped in the second solution containing 5 g/L of stannous sulphate and 5 ml/L of sulphophthalic acid at 25° C. with natural pH 1.8, for 2 minutes. After this treatment the sample is sealed according to current North American automotive practice, which is to pre-seal in a solution containing 2 g/L nickel acetate and 2 g/L of a dispersant agent (e.g. Precision 100) for 45 seconds, then seal in hot water (98° C.) for 15 minutes. The colour intensity, the colour uniformity, and its light fastness are equivalent to what is obtained with the earlier-described rinse method using a 2 g/L strength phosphomolybdic acid in the first dip, and corresponds to the colour intensity obtained using an inter-dip rinse time of 15–30 seconds.

We claim:

1. A method of colouring by means of a compound of molybdenum a porous anodic oxide film on the surface of an aluminum article, said colouring being effected without application to the article of an electric current, characterized by the steps of:

(a) dipping the article in an aqueous solution of a phosphomolybdic acid or a silicomolybdic acid for a time sufficient to effect absorption thereof by the anodic oxide film, (b) dipping the article from (a) in an aqueous solution of a reducing agent for a time to effect colour development in the anodic oxide film, and (c) sealing the coloured anodic oxide film.

2. A method as claimed in claim 1, wherein the aqueous solution used in step (a) contains phosphomolybdic acid or silicomolybdic acid at a concentration of from 0.1 to 15 g/L.

3. A method as claimed in claim 1, wherein the aqueous solution used in step (a) contains phosphomolybdic acid at a concentration of 1 to 15 g/L and the article is rinsed with water between steps (a) and (b).

4. A method as claimed in claim 3, wherein the pH of the solution is from 1 to 2.4 and the temperature is from 15° to 40° C.

5. A method as claimed in claim 1, wherein the aqueous solution used in step (a) contains less than 1 g/L of the phosphomolybdic or silicomolybdic acid, and the article is not rinsed between steps (a) and (b).

6. A method as claimed in claim 1, wherein the reducing agent used in step (b) is a stannous salt.

7. A method as claimed in claim 6, wherein the aqueous solution used in step (b) contains 5–10 g/L of stannous sulphate and 2–10 g/L of a stabiliser therefor and is used at a temperature of 15°–25° C.

8. A method as claimed in claim 1, wherein steps (a) and (b) are performed continuously on a continuous aluminium article.

9. A method as claimedin claim 1, wherein, after step (b) and prior to sealing, phosphate or silicate contamination is removed by water rinsing.

10. A method as claimed in claim 1, wherein sealing of the oxide film is effected by a steam sealing or by the use of a nickel-based sealing additive at a near boiling or by a nickel fluoride/butyl alcohol system.

* * * * *